US011478914B2

(12) United States Patent
Hyyrönmäki

(10) Patent No.: US 11,478,914 B2
(45) Date of Patent: Oct. 25, 2022

(54) TOOL BUSHING, BREAKING HAMMER AND MOUNTING METHOD

(71) Applicant: SANDVIK MINING AND CONSTRUCTION OY, Tampere (FI)

(72) Inventor: Jyrki Hyyrönmäki, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 267 days.

(21) Appl. No.: 16/403,433

(22) Filed: May 3, 2019

(65) Prior Publication Data

US 2019/0344417 A1 Nov. 14, 2019

(30) Foreign Application Priority Data

May 11, 2018 (EP) ..... 18171764

(51) Int. Cl.
*B25D 17/08* (2006.01)

(52) U.S. Cl.
CPC ..... *B25D 17/08* (2013.01); *B25D 2217/0096* (2013.01); *B25D 2250/331* (2013.01)

(58) Field of Classification Search
CPC ..... B25D 9/02; B25D 9/06; B25D 17/245; B25D 17/08; B25D 2217/0096; B25D 2250/331
See application file for complete search history.

(56) References Cited

U.S. PATENT DOCUMENTS 6,510,904 B1 * 1/2003 Tyrrell ..... B25D 17/08 173/128
2005/0158135 A1 * 7/2005 Massa ..... B23B 31/006 409/234
2011/0240322 A1 * 10/2011 Kandelin ..... B25D 9/18 173/104
2013/0056940 A1 * 3/2013 Doberenz ..... B25D 17/08 279/19
2013/0081837 A1 * 4/2013 Jagdale ..... E02D 7/18 173/90
2014/0261827 A1 * 9/2014 Moore ..... B25D 9/145 138/30
2015/0068782 A1 * 3/2015 Mellwig ..... B25D 9/14 173/90
2015/0123357 A1 * 5/2015 Stern ..... B23B 31/1071 279/78

(Continued)

FOREIGN PATENT DOCUMENTS

CN 1915606 A 2/2007
CN 102294674 A 12/2011

(Continued)

*Primary Examiner* — Nathaniel C Chukwurah
*Assistant Examiner* — Lucas E. A. Palmer
(74) *Attorney, Agent, or Firm* — Corinne R. Gorski

(57) ABSTRACT

A tool bushing of a breaking hammer, a tool bushing arrangement, a breaking hammer and a method of mounting a tool bushing of a breaking hammer are disclosed. The tool bushing is a sleeve-like piece having a multi-shouldered outer surface with three or more successive cylindrical portions. The cylindrical portions have different diameters that match with corresponding surfaces of a bushing housing when the tool bushing is mounted. Diameters of the bushing and the bushing housing are dimensioned so that friction forces are generated when the bushing is assembled.

9 Claims, 4 Drawing Sheets

(56) References Cited

U.S. PATENT DOCUMENTS

| | | | | |
|---|---|---|---|---|
| 2015/0129269 | A1* | 5/2015 | Muuttonen | B25D 17/245 173/105 |
| 2016/0067857 | A1* | 3/2016 | Moore | B25D 17/26 173/20 |
| 2017/0072551 | A1* | 3/2017 | Moore | F16C 29/02 |
| 2017/0087703 | A1* | 3/2017 | Moore | B25D 9/145 |
| 2018/0104806 | A1* | 4/2018 | Moore | B25D 9/04 |
| 2018/0126535 | A1* | 5/2018 | Neathery | B25D 17/08 |

FOREIGN PATENT DOCUMENTS

| | | | |
|---|---|---|---|
| CN | 202438351 | U | 9/2012 |
| CN | 103046600 | A | 4/2013 |
| CN | 203361227 | U | 12/2013 |
| CN | 105401609 | A | 3/2016 |
| CN | 105536933 | A | 5/2016 |
| CN | 105909166 | A | 8/2016 |
| CN | 207110960 | U | 3/2018 |
| EP | 2873489 | A1 | 5/2015 |
| GB | 103619 | A | 2/1917 |
| GB | 1537326 | A | 12/1978 |

* cited by examiner

TOOL BUSHING, BREAKING HAMMER AND MOUNTING METHOD

RELATED APPLICATION DATA

This application claims priority under 35 U.S.C. § 119 European Patent Application No. 18171764.6 filed May 11, 2018.

TECHNICAL FIELD

The present disclosure relates to a lower tool bushing of a breaking hammer. The tool bushing is a sleeve-like piece which is located inside a bushing housing at a lower end portion of a frame of the breaking hammer. A tool of the breaking hammer passes through the tool bushing and an inner surface of the bushing serves as a bearing surface for the tool. Fastening of the tool bushing is based at least partly to mutual sizes of an outer diameter of the bushing and an inner diameter of the bushing housing, whereby friction locking is utilized. The disclosure further relates to a bushing arrangement of a breaking hammer, and further to a breaking hammer and a method of mounting a tool bushing of a breaking hammer.

BACKGROUND

Breaking hammers are used to break hard materials, such as rock, concrete, and the like. The breaking hammer includes a percussion device for generating impact pulses to a breaking tool connectable to the breaking hammer. The tool is supported by a frame of the breaking hammer by means of one or more tool bushings, which are sleeve-like objects through which the tool passes and reciprocates during its operation. At a lower end of the breaking hammer there is a lower tool bushing, which is subjected to significant transverse loadings during the breaking. The lower tool bushing is also subjected to wear because of the reciprocating tool movement, and further, because impurities may pass between the tool and the bushing despite of protective tool seals. Thus, especially the lower tool bushing may deform and wear whereby it needs to be changed time to time.

The lower end portion of the frame is typically designed so that the lower tool bushing can be changed without need for extensive dismantling measures. The tool bushing is typically locked inside the bushing housing by using friction locking principles and interference fitting between the bushing and the bushing housing.

However, the known solutions have drawbacks relating to dismounting and mounting of the tool bushings. These known solutions have shown to be time consuming and laborious, and sometimes the replacement work is impossible to execute in field circumstances and without extensive dismantling measures and tooling.

SUMMARY

One aspect of the present disclosure is to provide a lower tool bushing of a breaking hammer that overcomes the above disadvantages. Another aspect is to provide a tool bushing arrangement, a breaking hammer and a method of mounting a tool bushing, which all aim to facilitate maintenance of the breaking hammer.

According to the present disclosure, the tool bushing is arranged to be fastened inside a bushing housing predominantly by means of friction fastening generated during mounting between outer surfaces of the tool bushing and inner surfaces of the bushing housing. Further, outer dimensions of the tool bushing are arranged to increase stepwise towards a front or first end of the tool bushing. In other words, the tool bushing has a multi-stepped configuration and has three or more cylinder sections with differing diameters formed in successive order.

The outer surface of the tool bushing is multi-shouldered. Correspondingly, the bushing housing is provided with a corresponding inner surface formation so that the bushing housing can receive the tool bushing and form several friction locking sections between the opposing inner and outer shoulders.

Accordingly, mounting of the tool bushing is facilitated when several stepped locking shoulders are used. The total locking force for the tool bushing is generated by several stepped shoulders, whereby an axial mounting length of the bushing may be short. Great axial forces are required in the mounting process and generating short mounting movement with pressing and pulling devices is significantly easier than forming long movements with great forces.

Since the total axial length of the tool bushing is divided into several successive shoulders frictional forces occur at all shoulder sections of the bushing, but still the mounting length may be short. Due to the disclosed multi-shoulder structure, the bushing has easy removal and mounting features, whereby the lower tool bushing can be serviced in field conditions and with the help of reasonable mounting tooling.

Normally dismounting and mounting can be executed by subjecting pulling/pushing forces to the bushing and no time consuming heating/cooling measures for generating thermal expansion are required, whereby maintenance work is facilitated and made quicker. One additional advantage is that the friction mounting of the bushing tolerates possible minor axial movements of the bushing without losing the mounting force since the solution is based on the use of cylindrical surfaces having axial lengths, whereas in some prior art solutions relating to tapered contact surfaces the locking force is vulnerable to any kind of axial movement.

A further additional advantage of the disclosed solution is that when the bushing is fitted firmly without a clearance with the bushing housing, impurities and moisture are effectively prevented from entering inside the structure of the breaking hammer, resulting thereby in a longer operating life of the breaking hammer and lower need for service and downtime.

Further, the cylindrical mating surfaces of the tool bushing assembly are relatively easy to machine on the surfaces of the tool bushing and the bushing housing, whereas forming accurate tapered surfaces disclosed in some prior art solutions is more complicated and expensive.

According to an embodiment, the multi-stepped tool bushing has six, seven or even more stepped cylindrical sections following each other and having stepwise increasing diameters. The number of the successive cylindrical sections may be in relation to total axial length and size of the tool bushing. For example, the longer and greater the size of the bushing, the greater the amount of shoulders.

According to an embodiment, mutual diameters of the tool bushing and the bushing housing are dimensioned so that no radial clearance exists in the installed state between the mating cylindrical sections of the tool bushing and the bushing housing.

According to an embodiment, the diameters of the shoulders of the tool bushing are dimensioned according to interference fitting tolerances. Thus, a light interference fit may be utilized in the mounting. However, even though diameters of the bushing and the bushing housing are dimensioned to have a very small gap, depending on manufacturing tolerances, the tool bushing will still remain firmly in place by means of friction forces, since there exists typically at least minor deviations in cylindrical shapes of the nested surfaces of the bushing arrangement. The disclosed interference fitting is advantageous since it allows dismounting and mounting in field conditions and without use of extensive mounting tooling.

According to an embodiment, the diameters of the shoulders of the tool bushing are dimensioned according to tight-fitting tolerances. This embodiment may be utilized in special cases when sufficiently great mounting forces are generated and heating/cooling means are available.

According to an embodiment, a front edge of the second end of the tool bushing is provided with a chamfer. The chamfer aligns the tool bushing relative to the bushing housing at the beginning of the mounting of the bushing. The initial alignment may be done manually.

According to an embodiment, the tool bushing includes at least one peripheral lubricating groove on the outer periphery, and the lubricating groove is provided with several radial through holes extending from the outer periphery to the inner periphery thereby forming passages for lubricating agent. The lubricating groove allows lubricating grease to be fed to bearing surfaces so that longer service life is achieved.

According to an embodiment, the inner periphery of the first shoulder of the tool bushing includes a seal groove, which is located at the first end portion of the tool bushing and is configured to receive a sealing ring for sealing a radial gap between the breaking tool and the tool bushing.

According to an embodiment, step height of the shoulders can be dimensioned to be 0.1-1.0 mm. Thereby, sizes of diameters of every two successive cylindrical sections differ 0.2-2 mm from each other.

According to an embodiment, each shoulder has an effective axial shoulder length dimension of which is 20-60 mm. The axial shoulder length may be dimensioned according to stroke length of a hydraulic jack used for the dismounting and mounting. Thereby the mounting length of the tool bushing is 20-60 mm and the total length of the tool bushing is several times greater than the mounting length, typically at least 200 mm. The generated friction fastening extends from end to end of the tool bushing, whereby there needs to be several shoulders to provide the desired fitting for the total length of the tool bushing.

According to an embodiment, at the first end of tool bushing there is a first shoulder and several following shoulders are located between the first shoulder and the second end. Dimensions of axial lengths of the shoulders following the first shoulder can be dimensioned to be 20-60 mm.

According to an embodiment, at the first end of the tool bushing there is a first shoulder having an actual axial shoulder length greater than the effective axial shoulder length of the first shoulder. Actual physical length of the first shoulder can be 2-5 times greater than the length of the other shoulders. In other words, the first shoulder may have an extra axial portion extending outside the outermost portion of the bushing housing.

According to an embodiment, the tool bushing is without the extra length of the first shoulder disclosed in the previous embodiment. In this way, the lowermost shoulder with the greatest diameter may have the same axial length as the other shoulders, whereby the tool bushing does not protrude from the bushing housing.

According to an embodiment, on the outer surface of the tool bushing is at least one axial alignment groove extending from the second end along a limited axial length towards the first end. The alignment groove may receive a transverse alignment screw or pin mounted to the bushing housing. The alignment groove and pin arrangement is advantageous when the mounting system of the tool bushing has a locking pin. Then, the alignment system ensures, at the beginning of the mounting, that the tool bushing has a correct angular position relative to the bushing housing so that when the bushing is pressed inside the bushing housing, locking pin grooves of the bushing and the bushing housing align and form a locking pin opening capable to receive the locking pin.

According to an embodiment, the second end portion of the tool bushing is provided with at least two axial alignment grooves allowing the tool bushing to be aligned in at least two alternative rotational positions inside the bushing housing. The alignment grooves may be disposed at 90° relative to one another. This way the alignment grooves may determine desired alternative mounting positions for the bushing and may thereby facilitate maintenance of the lower tool bushing.

According to an embodiment, the axial length of the at least one axial alignment groove is dimensioned to be greater than the aforementioned effective axial shoulder length and extends thereby axially from the second end over at least one shoulder.

According to an embodiment, the tool bushing arrangement includes an additional locking system based on shape locking. Then, on the outer surface of the tool bushing there is a transverse locking groove, which is located at a section between the second end and longitudinal middle point of the tool bushing. The bushing housing includes a similar transverse groove at the same location whereby the grooves form together an opening, which is configured to receive a transverse locking pin when the bushing is installed inside the bushing housing. In normal operation the disclosed friction forces keep the bushing firmly and immovable secured inside the bushing housing and the locking pin arrangement only secures the mounting.

According to an embodiment, the outer surface of the tool bushing includes at least two locking grooves, which are located on a same transverse plane relative to the longitudinal axis of the tool bushing and which locking grooves are positioned at 90° relative to one another. An advantage of the crossing locking grooves is that the tool bushing may be turned 90° when the inner surface of the tool bushing wears during the use. By turning the tool bushing operating life of the tool bushing may be extended. The above-mentioned alignment system has two selectable alignment grooves that operate in co-operation with the pin locking system having two selectable locking grooves.

According to an embodiment, another solution relates to a tool bushing arrangement of a breaking hammer. A bushing housing includes an inner space for receiving the lower tool bushing. The bushing and the bushing housing are both provided with stepped surfaces, which match to each other and form several friction locking pairs. Diameters of the stepped surfaces are dimensioned so that there are no mutual radial clearances between the mating cylinder surfaces. In this way, the bushing is retained firmly in place and there is no need for sealing elements between the bushing and the bushing housing.

According to an embodiment, between each shoulder of the tool bushing and respective mating cylindrical inner surface of the bushing housing surrounding the respective shoulder is a light interference fit or interference fit, whereby the friction fitting exists on several diameters.

According to an embodiment, the tool bushing is retained inside the bushing housing by means of a press fit. An axial mounting length of the press fit can be 20-60 mm.

According to an embodiment, the disclosed solution relates to a breaking hammer including a front head defining a bore therein, an inner surface of the bore having a first multi-shouldered surface with at least three successive shoulders each provided with different diameters, and a lower bushing arranged to be positioned within the bore, an outer surface of the lower bushing having a second multi-shouldered surface matching with the first multi-shouldered surface.

According to an embodiment, the solution further relates to a method of mounting a tool bushing of a breaking hammer. The method includes inserting the above disclosed multi-stepped tool bushing inside a bushing housing and retaining the bushing predominantly by means of a friction fitting between the several mating cylindrical surfaces of the tool bushing and the bushing housing. The bushing is forced inside the bushing housing and then the needed retaining forces are generated.

The bushing may be mounted by using two successive pushing phases. The bushing is in a first pushing phase when pushed manually partly inside the bushing housing and is in a second pushing phase pushed with force into a final installation position by means of a pressing device. Further, the second pushing with the pressing device is extended for an axial mounting length, a magnitude of which can be 20-60 mm. An advantage of the short mounting length is that size and weight of the pressing device may be reasonable and the device is easy to handle manually.

According to an embodiment, the mounting and dismounting is executed by a portable pressing and pulling device having a maximum movement or stroke length of 60 mm.

According to an embodiment, the method includes steps for changing an angular position of an existing tool bushing. The method includes pulling an already installed tool bushing backwards from the bushing housing for a longitudinal distance, magnitude of which is greater than the mentioned axial mounting length. The tool bushing may be left partly inside the bushing housing, but the friction fastening is loosened. Thereafter, the loosened tool bushing is turned relative to the central axis of the tool bushing to a different angular position compared to the previous angular position. When correctly positioned, the tool bushing may be pushed longitudinally back inside the bushing housing whereby the tool bushing is secured into a new angular position by means of friction forces. Wearing of the bearing surface of the tool bushing is typically not evenly distributed, thus an advantage of this embodiment is that by turning the bushing into different positions, operating life of the bushing may be prolonged. Also, the change is fast and easy to execute when the disclosed multi-stepped solution is utilized.

According to an embodiment, contact surfaces between the bushing housing and the tool bushing are without any sealing elements. The interference fitting between these objects ensures that no impurities may penetrate through the connection inside the frame. Further, the fitting remains impermeable to dirt even when minor axial movement occurs between the mating surfaces.

It should be appreciated that the disclosed tool bushing is also suitable for other types of breaking hammers than those disclosed herein. Accordingly, the percussion or impact device may differ from the one shown and described. Moreover, for example, around the frame of the breaking hammer may or may not be a protective casing surrounding the frame.

The above-disclosed embodiments can be combined to form desired solutions provided with necessary features disclosed. The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION

Figure 1:
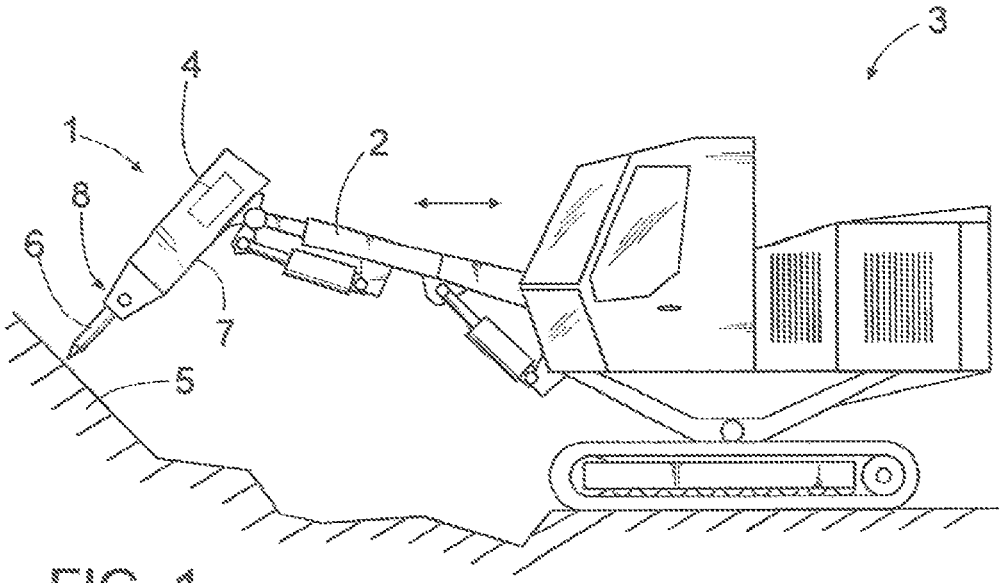
FIG. 1 is a schematic side view of an excavator, which is provided with a breaking hammer.

FIG. 1 shows a breaking hammer 1 arranged on a free end of a boom 2 in a working machine 3, such as an excavator. Alternatively, the boom 2 may be arranged on any movable carriage or on a fixed platform of a crushing apparatus. The breaking hammer 1 includes a percussion device 4 arranged to generate impact pulses. The breaking hammer 1 may be pressed by means of the boom 2 against material 5 to be broken and impacts may be simultaneously generated with the percussion device 4 to a tool 6 connected to the breaking hammer 1. The tool 6 transmits the impact pulses to the material 5 to be broken.

The percussion device 4 may be hydraulic, whereby it may be connected to the hydraulic system of the working machine 2. Alternatively, the percussion device 4 may be electrically or pneumatically powered. The impact pulses may be generated in the percussion device 4 by means of a percussion element, such as a percussion piston, that may be moved back and forth in the impact direction and return direction under the influence of hydraulic fluid. Further, the breaking hammer 1 may have a protective casing 7, inside which the percussion device 4 may be located. At a lower end of the breaking hammer, i.e. at the tool side end, is a lower tool bushing arrangement 8 for bearing the tool 6 to a frame of the breaking hammer. The tool bushing arrangement 8 comprises a tool bushing disclosed in this patent application.

Figure 2:
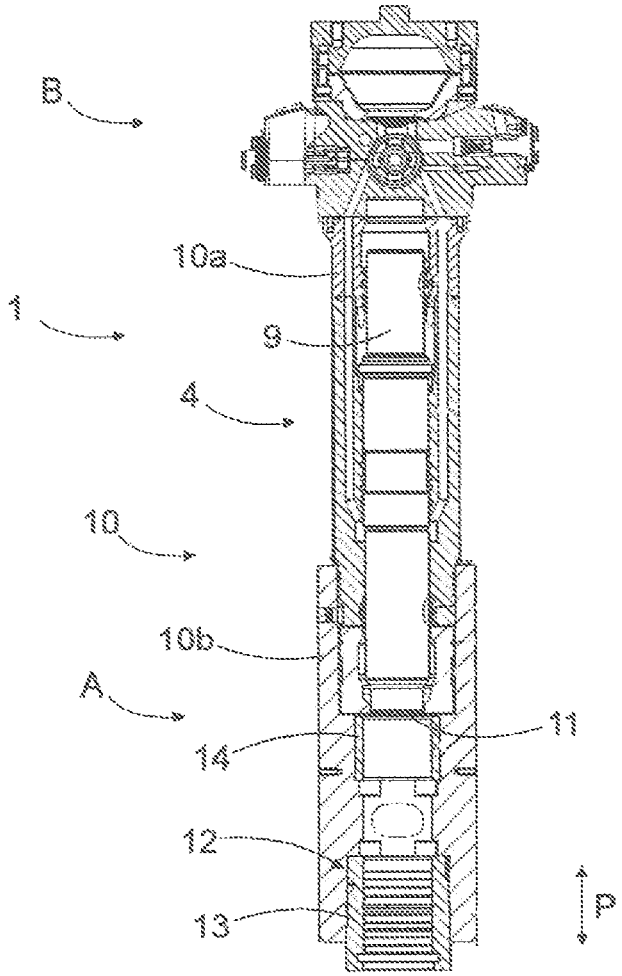
FIG. 2 is a schematic and cross-sectional side view of a percussion device of a breaking hammer.

FIG. 2 discloses a structure of a percussion device 4 of a breaking hammer 1. The breaking hammer includes a lower end A at a tool side end and an upper end B. A percussion device 4 may have a percussion piston 9 arranged to move to and fro relative to a frame 10 of the percussion device 4. An impact surface 11 of the percussion piston 9 is arranged to strike an upper end of a tool (not shown in FIG. 2). The tool is allowed to move in the axial direction P during use. The frame 10 may have an upper frame part 10*a* and a lower frame part 10*b*.

At the lower end of the lower frame part 10*b* of the breaking hammer 1 is a bushing housing 12 configured to receive a sleeve-like lower tool bushing 13. The tool is also supported by means of an upper tool bushing 14, which is mounted in place when the lower frame 10*b* is detached. The tool is configured to pass through the lower and upper tool bushings 13, 14, which both serve as bearing and support elements for the tool. However, the lower tool bushing 13 is subjected to greater mechanical forces and wear than the upper tool bushing 14, thus the lower tool bushing needs to be serviced and changed more often. Since the bushing housing 12 of the lower tool bushing 13 opens towards the lower end A of the breaking hammer 1, the bushing 13 can be dismounted without dismantling the basic structure of the frame 10.

Figure 3:
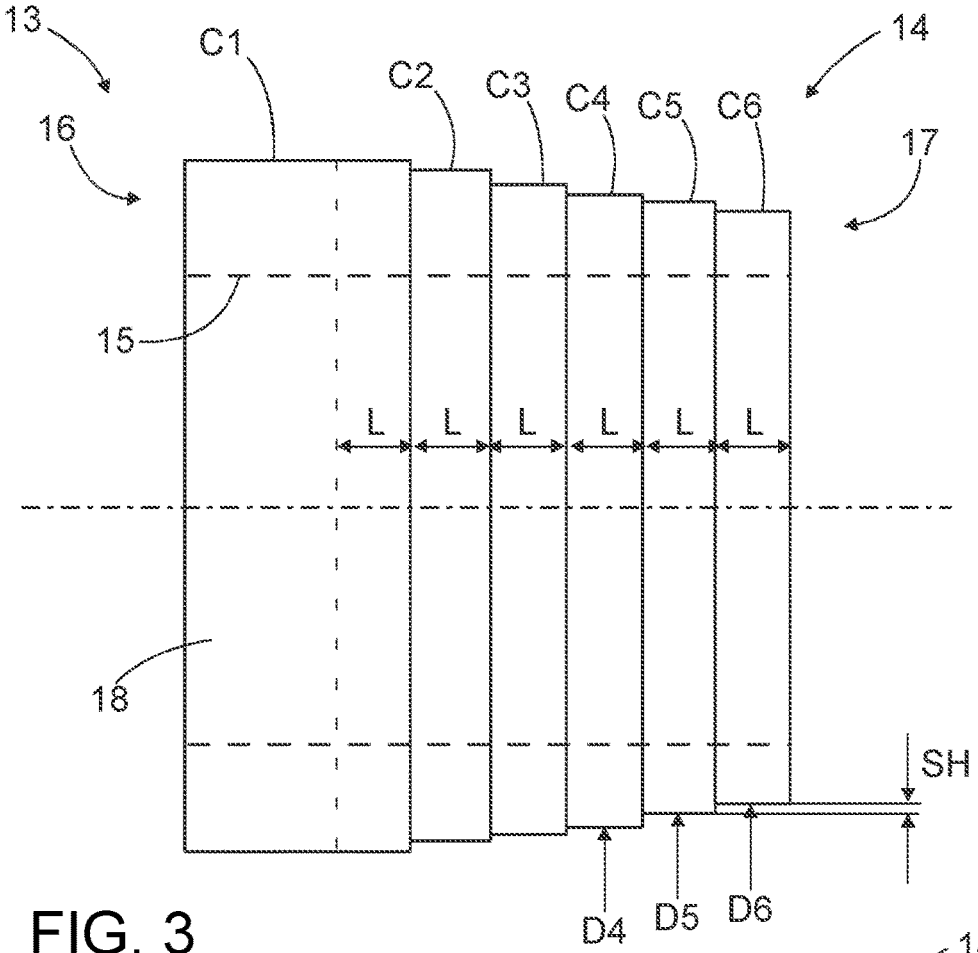
FIG. 3 is a schematic side view of a lower tool bushing having six successive cylindrical outer sections with differing diameters.

FIG. 3 shows, in an enhanced manner, a lower tool bushing 13 with an outer periphery 14 including six cylindrical sections C1-C6 with differing diameters D1-D6. The nominal outer diameter of the bushing depends on the size and capacity of the breaking hammer and may typically be between 150-250 mm. An inner periphery 15 of the bushing serves as a bearing surface against a breaking tool. As can be noted, a first cylindrical section C1 at a first end 16 or lower end of the bushing has the greatest diameter D1 and the opposite second end 17 or upper end has the smallest diameter D6. Thus, the outer surface of the bushing 13 is multi-stepped or multi-shouldered. Step height SH between adjacent shoulders may be 0.1-1.0 mm, for example. Further, each of the cylindrical sections C1-C6 or shoulders has an effective axial shoulder length L, which may be 20-60 mm.

In FIGS. 2 and 3, the lower tool bushing 13 has an extension portion 18 with an axial length, which may be multiplied relative to the effective axial shoulder length L, and which may protrude from the bushing housing 1, as shown in FIG. 2.

Figure 4:
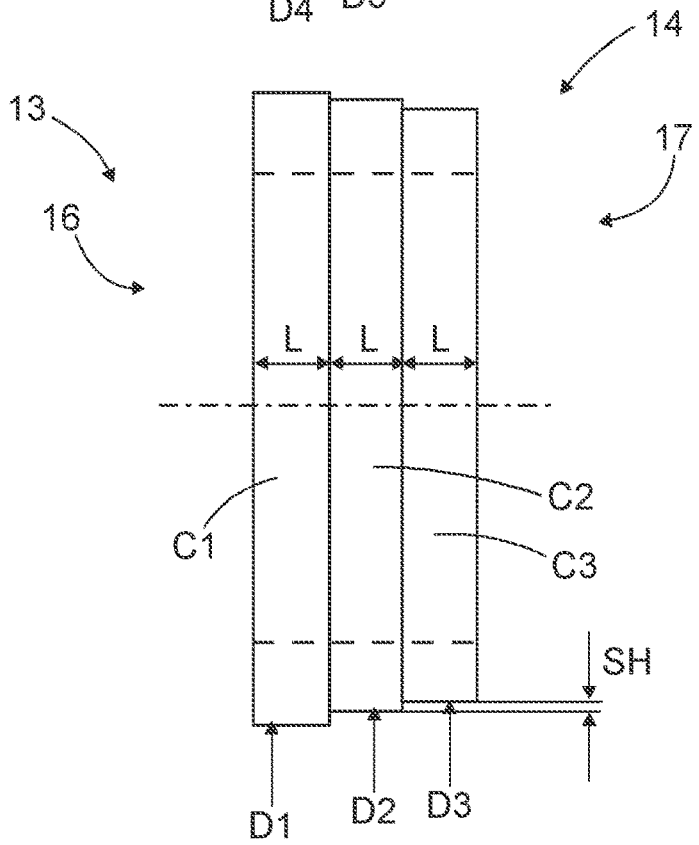
FIG. 4 is a schematic side view of another lower tool bushing comprising three cylindrical outer sections or shoulders.

FIG. 4 shows in an enhanced manner a three-stepped tool bushing 13. The basic features of the bushing 13 of FIG. 4 correspond to the bushing 13 of FIG. 3 except that the first cylindrical section C1 is without any extension portion 18.

Figure 5:
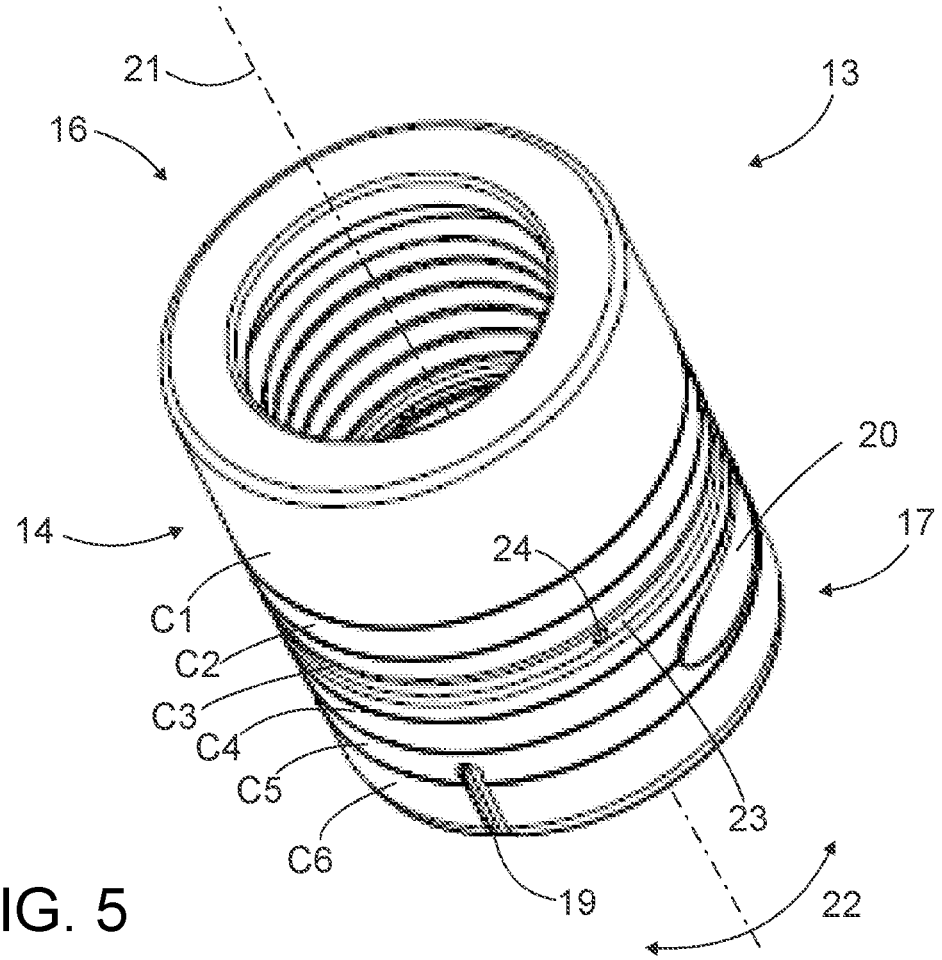
FIG. 5 is a schematic and perspective view of a tool bushing and also shows an axial alignment groove and a transverse locking groove.

FIG. 5 illustrates a tool bushing 13, the basic structure of which is in accordance with the one shown in FIG. 3. However, in FIG. 5 axial alignment groove 19 and a transverse locking groove 20 are shown. The number of alignment grooves 19 and locking grooves 20 may be two or more so that the bushing 13 has two or more alternative angular positions relative to central axis 21 of the bushing 13. Thus, the bushing 13 is turnable 90°, for example, as indicated by arrow 22. Further, on the outer periphery of the bushing 13 may be a lubricating groove 23 and several lubricating holes 24 passing through wall of the bushing 13.

Figure 6:
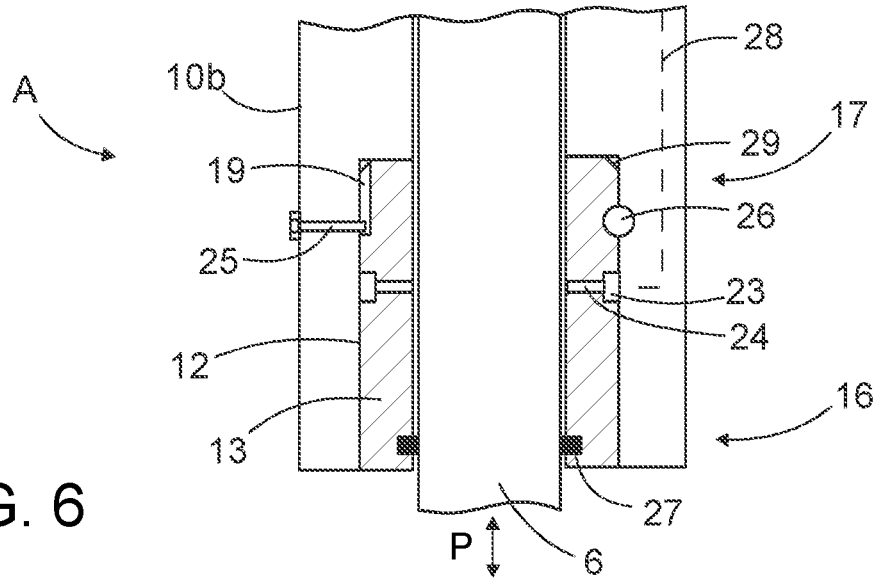
FIG. 6 is a schematic and cross-sectional side view of a lower end portion of the breaking hammer.

FIG. 6 discloses in a simplified manner a lower end A of the breaking hammer. A tool bushing 13 is mounted inside a bushing housing 12. Mating surfaces of the bushing 13 and the bushing housing 12 are provided with multi-shouldered formations as described herein. For clarity reasons the surfaces are shown without the stepped structure. At a second end portion 17 of the bushing 13 there is one or more alignment grooves 19 arranged to receive protruding alignment pins 25, such as screws. Fastening of the bushing 13 is based on friction mounting, but there may be a second fastening system, namely a transverse locking pin 26 arrangement.

Between tool 6 and the bushing 13 is a tool seal 27, which is a sealing ring arranged partly inside a sealing groove formed on inner periphery of the bushing 13 at the first end portion 16 of the bushing 13. FIG. 6 further discloses that a lubricating agent may be conveyed through a conduct 28 to a lubricating groove 23 wherefrom the lubricating agent may pass through lubricating holes 24 to a gap between the tool 6 and the bushing 13. An outer edge of the second end of the bushing 13 has a chamfer 29 for alignment purposes.

Figure 7:
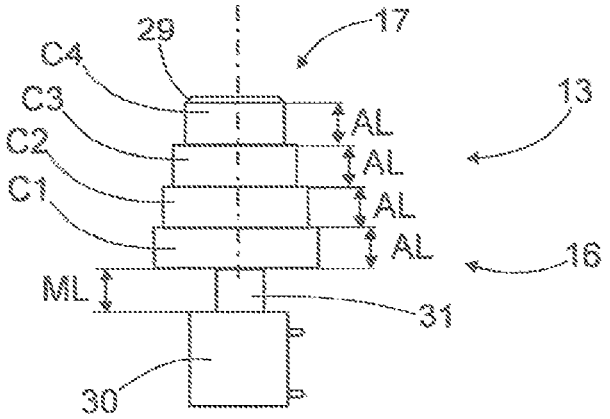
FIG. 7 is a schematic side view of a mounting setting having a hydraulic jack.

FIG. 7 illustrates the mounting of a four-stepped lower tool bushing 13 by means of a pressing device 30, which may be a hydraulic jack having a piston 31 with a maximum stroke length defining a maximum mounting length ML. The bushing 13 has four cylinder sections C1-C4 and each of them has an axial length AL, which is equal or shorter than the maximum mounting length ML.

Figure 8:
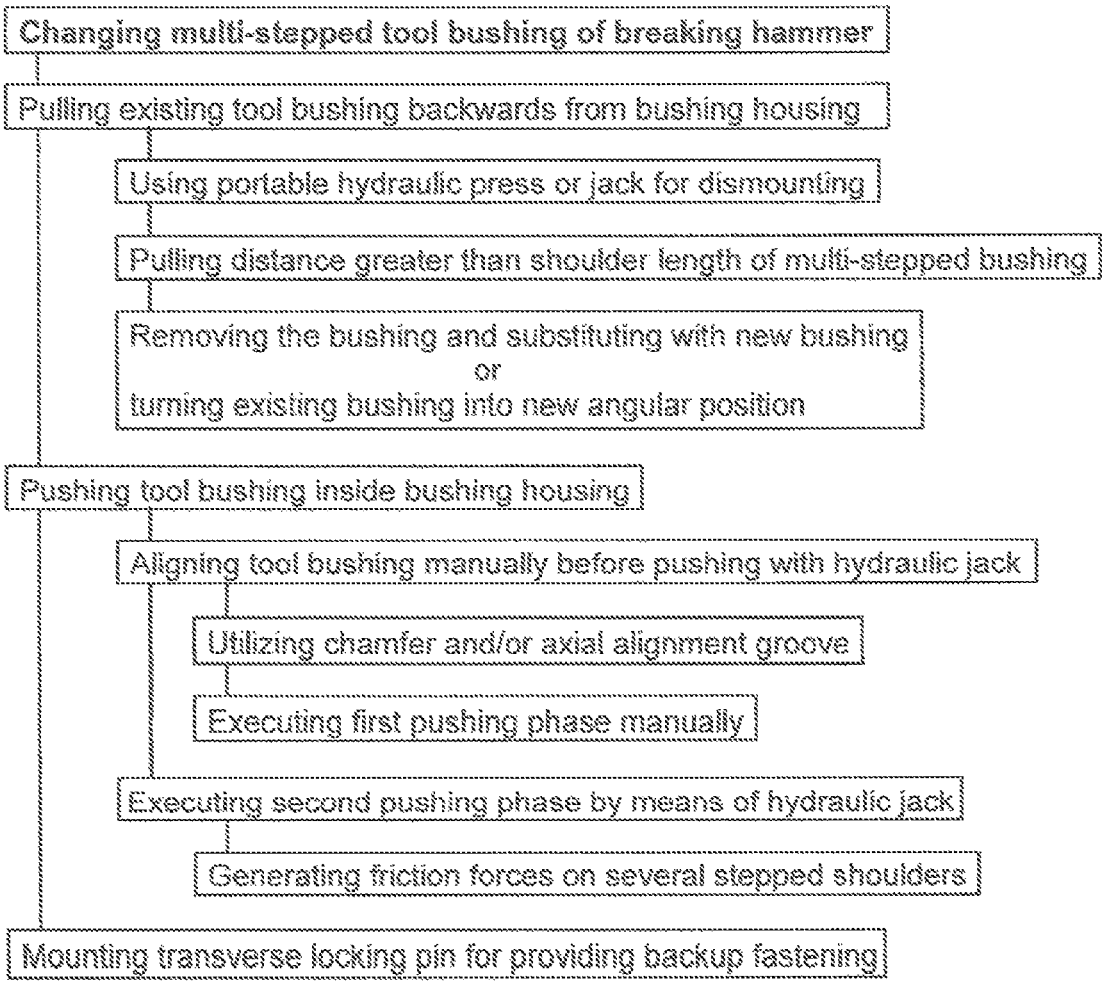
FIG. 8 is a schematic diagram showing steps relating to change or turning measures of the tool bushing.

FIG. 8 illustrates the steps of a maintenance process of a tool bushing as described above.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A tool bushing of a breaking hammer comprising:

a sleeve-like piece having an inner periphery, an outer periphery and an axial length, the inner periphery forming a direct bearing surface arranged to face a breaking tool to be supported, and the outer periphery being arranged to face a bushing housing;

a first end having a first outer diameter and a second end having a second outer diameter, wherein the first diameter is greater than the second diameter, the outer periphery of the tool bushing having a multi-shoulder configuration including a plurality of shoulders forming at least three successive cylindrical sections having differing diameters, wherein sizes of the diameters of the shoulders are dimensioned to increase step-by-step towards the first end, wherein the outer periphery is provided with at least one first groove, the at least one first groove being a transverse locking groove, which is located at a section between the second end and a longitudinal middle point of the tool bushing, the at least one transverse locking groove being arranged to partly receive a transverse locking pin in an installed state; and at least one second groove, the at least one second groove being an axial alignment groove disposed on the outer periphery and extending from the second end along a limited axial length towards the first end.

2. The tool bushing as claimed in claim 1, wherein the outer periphery is stepped into at least six successive cylindrical sections, the diameters of which are different in size.

3. The tool bushing as claimed in claim 1, wherein a step height of the shoulders is 0.1-1.0 mm, whereby sizes of the diameters of every two successive cylindrical sections differ 0.2-2 mm from each other.

4. The tool bushing as claimed in claim 1, wherein each shoulder has an effective axial shoulder length of 20-60 mm.

5. A tool bushing arrangement of a breaking hammer comprising:

a breaking tool, which is an elongated piece;

a tool bushing in accordance with claim 1, the tool bushing being located around the breaking tool and having at least one cylindrical outer surface; and a bushing housing configured to receive the tool bushing inside at least one cylindrical inner surface, wherein the tool bushing is predominantly retained therein by a friction fitting between the at least one cylindrical outer surface of the tool bushing and the at least one cylindrical inner surface of the bushing housing, the bushing housing having a corresponding multi-shouldered configuration with several successive cylindrical inner surfaces with differing diameters for receiving the several cylindrical outer surfaces of the multi-shouldered tool bushing, and wherein the diameters of the outer cylindrical surfaces of the tool bushing and the diameters of the mating inner cylindrical surfaces of the bushing housing are dimensioned to be without mutual radial clearances.

6. The tool bushing arrangement as claimed in claim 5, wherein between each shoulder of the tool bushing and a respective mating cylindrical inner surface of the bushing housing surrounding the respective shoulder is a light interference fit or interference fit, whereby the friction fitting exists on the diameters of the outer cylindrical surfaces.

7. The tool bushing arrangement as claimed in claim 5, wherein the tool bushing is retained by a press fit having an axial mounting length of 20-60 mm.

8. A breaking hammer, comprising:

a percussion device including a frame and an impact element arranged inside the frame;

a breaking tool connectable to the percussion device and arranged to protrude from the frame;

a tool bushing in accordance with claim 1 located around the breaking tool and having at least one cylindrical outer surface; and a bushing housing, which is located at a tool side end of the frame and being configured to receive the tool bushing inside at least one cylindrical inner surface, wherein the tool bushing is predominantly retained by a friction fitting between the at least one cylindrical outer surface of the tool bushing and the at least one cylindrical inner surface of the bushing housing, the bushing housing having a corresponding multi-shouldered configuration with several successive cylindrical inner surfaces with differing diameters arranged for receiving the cylindrical outer surfaces of the multi-shouldered tool bushing, wherein the diameters of the outer cylindrical surfaces of the tool bushing and the diameters of the mating inner cylindrical surfaces of the bushing housing are dimensioned to be without mutual radial clearances.

9. The tool bushing as claimed in claim 1, wherein the at least one first groove is perpendicular to the at least one second groove.

* * * * *